US006579384B2

(12) United States Patent
Usui et al.

(10) Patent No.: US 6,579,384 B2
(45) Date of Patent: Jun. 17, 2003

(54) BALL FOR CONSTANT-VELOCITY JOINT AND METHOD OF MANUFACTURING SUCH BALL

(75) Inventors: Yoshimi Usui, Tochigi-ken (JP); Kazuto Fukuda, Toyama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/974,861

(22) Filed: Oct. 12, 2001

(65) Prior Publication Data

US 2002/0062882 A1 May 30, 2002

(30) Foreign Application Priority Data

Oct. 13, 2000 (JP) ..... 2000-312770

(51) Int. Cl.[7] ..... C22C 38/00; C23C 8/26; C23C 8/50

(52) U.S. Cl. ..... 148/318; 148/906; 148/232; 384/912; 384/625

(58) Field of Search ..... 148/318, 906, 148/232; 384/912, 625

(56) References Cited

U.S. PATENT DOCUMENTS 6,315,455 B1 * 11/2001 Tanaka et al. ..... 384/492

FOREIGN PATENT DOCUMENTS

| | | |
|---|---|---|
| JP | A6-173967 | 6/1994 |
| JP | B23047088 | 3/2000 |
| JP | A2000-74082 | 3/2000 |
| JP | A2000-145804 | 5/2000 |
| JP | A2000-145805 | 5/2000 |

* cited by examiner

*Primary Examiner*—Deborah Yee
(74) *Attorney, Agent, or Firm*—Birch, Stewart, Kolasch & Birch, LLP

(57) ABSTRACT

A ball for use in a constant-velocity joint, which is adapted to be interposed between an inner race and an outer race for transmitting rotational power therebetween, is produced by nitriding a surface of a ball made of bearing steel or a material equivalent thereto, and processing the nitrided ball for increased resistance to a crushing load. The nitrided ball is processed for increased resistance to a crushing load by tempering the ball at a temperature ranging from 180 to 230° C. The surface hardness of the ball should preferably be adjusted in the range from HRC 60 to 64.

3 Claims, 3 Drawing Sheets

BALL FOR CONSTANT-VELOCITY JOINT AND METHOD OF MANUFACTURING SUCH BALL

BACKGROUND OF THE INVENTION

1. Field of the Invention

The present invention relates to a ball for use in a constant-velocity joint such as a constant-velocity joint for use in automobiles, industrial machines, or the like, especially a constant-velocity joint for use in front and rear axles of automobiles, the ball being capable of increasing the service life of the constant-velocity joint, and a method of manufacturing such a ball.

2. Description of the Related Art

As shown in FIGS. 1 and 2 of the accompanying drawings, a constant-velocity joint 1 comprises an inner race 5, a cage (retainer) 7, an outer race 3, and a plurality of balls 6, and transfers a torque between the balls 6 and outer race grooves 3*b* and inner race grooves 5*b*. Recently, constant-velocity joints are required to be more compact because of the demand for high torque or weight reduction. However, small-size constant-velocity joints tend to have poor durability. Japanese laid-open patent publication No. 2000-145804 discloses ball rolling grooves in outer and inner races which are processed into a surface roughness ranging from 10 to 20 $\mu$m by shot blasting, then chemically treated to provide a surface layer of manganese phosphate or zinc phosphate, and coated with a solid lubricant film of molybdenum disulfide and graphite which are bonded by a resin. Japanese laid-open patent publication No. 6-173967 discloses ball rolling grooves having a hardened layer (nitrided layer) of quenched martensite structure with a solid solution of nitrogen.

Balls used in general constant-velocity joints are substantially identical to balls used in standard rolling bearings except that the former balls are slightly less accurate than the latter balls. The balls used in general constant-velocity joints are made of bearing steel (SUJ2: JIS G 4805) or an equivalent material. They are produced by hardening the material at a temperature ranging from 820 to 850° C. and then tempering it at a lower temperature ranging from 150 to 180° C. to provide a surface hardness of at least HRC (Rockwell hardness C scale) 62. According to Japanese laid-open patent publication No. 2000-145805, the diameter of balls is decreased to use an increased number of balls. However, since the number of balls used is increased, it is necessary to make efforts to assemble the balls neatly and design a retainer for holding those many balls. Japanese laid-open patent publication No. 2000-74082 discloses the use of steel balls that are heat-treated to stabilize heat-resistant dimensions in order to keep a remaining amount of austenite at 5% or less and make the surface hardness in the range from HRC 53 to 61. The disclosed steel balls are resistant to heat at high rotational speeds and at high angles, and are prevented from being deformed due to aging. Therefore, since the surface hardness is in the range from HRC 53 to 61 which is lower than general surface hardness ranges, the balls are low in durability. Furthermore, because the remaining amount of austenite is low, the surface of the balls is weak, and hence the balls tend to have a short service life. In addition, the balls used in constant-velocity joints are problematic in that since the balls have a cross hatch angle and make a composite motion including slipping and rolling motions, the surface of the balls tend to be damaged due to oil film interruptions thereon and peeled off.

According to Japanese patent publication No. 3047088, in order to increase the wear resistance and fatigue strength of balls for constant-velocity joints, the surface of the balls is carbonitrided and then tempered at 170° C. for 2 hours to achieve a hardness ranging from about HV 800 to 860 (from about HRC 64 to 66). However, since the carbonitrided surface has a high carbon concentration and is liable to be crushed under a reduced load, the balls tend to be damaged under shocks applied when the automobile with such constant-velocity joints runs on a gravel road or hits a curb.

The inventors of the present invention have attempted to apply the idea of the nitriding of ball rolling grooves as disclosed in Japanese laid-open patent publication No. 6-173967 to balls as taught by Japanese patent publication No. 3047088. However, when nitrided, balls become more liable to be crushed under a reduced load, and hence tend to crack and be damaged easily.

SUMMARY OF THE INVENTION

It is therefore a major object of the present invention to provide a ball for use in a constant-velocity joint, which is less subject to surface damage and has increased durability and hence a long service life, and a method of manufacturing such a ball.

According to the present invention, a ball for use in a constant-velocity joint, which is adapted to be interposed between an inner race and an outer race for transmitting rotational power therebetween, is made of bearing steel or a material equivalent thereto, and has a surface nitrided and processed for increased resistance to a crushing load.

The strength of the surface of the ball is increased by nitriding the surface of the ball to increase the remaining amount of austenite on the surface of the ball. When the surface of the ball is processed for increased resistance to a crushing load, it is prevented from suffering a reduction in the crushing load due to the nitriding process. The ball thus produced is resistant to surface damage and a high surface pressure, and has a high strength. The crushing load refers to a vertical load under which either one of two balls of the same nominal diameter superposed on a conical seat having an angle of 120° is broken, as defined in JIS B 1501, revised in 1983, Reference 3.

Since the resistance to the crushing load appears on the surface of the ball, the surface hardness of the ball may be adjusted to be in the range from HRC 60 to 64. If the surface hardness of the ball were smaller than HRC 60, then the surface hardness of the ball would be too small, and if the surface hardness of the ball were greater than HRC 64, then the crushing load would be too low.

The ball may be processed for increased resistance to a crushing load by lowering the hardening temperature or lowering the tempering temperature. According to the present invention, it is preferable to nitride the ball in an atmospheric temperature of 840° C., quench the ball in oil (after being nitrided or hardened by nitridation), and temper the ball in a temperature range from 180 to 230° C. Since the surface hardness of the ball which has excessively been increased by the nitridation is lowered by tempering the ball at a temperature higher than a general tempering temperature, the strength of the ball against the crushing load can be increased. If the tempering temperature were lower than 180° C., then the surface hardness of the ball would remain so high that the ball would be too weak under a crushing load. If the tempering temperature were higher than 230° C., then the surface hardness of the ball would become too low to make the ball resistant to surface damage.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
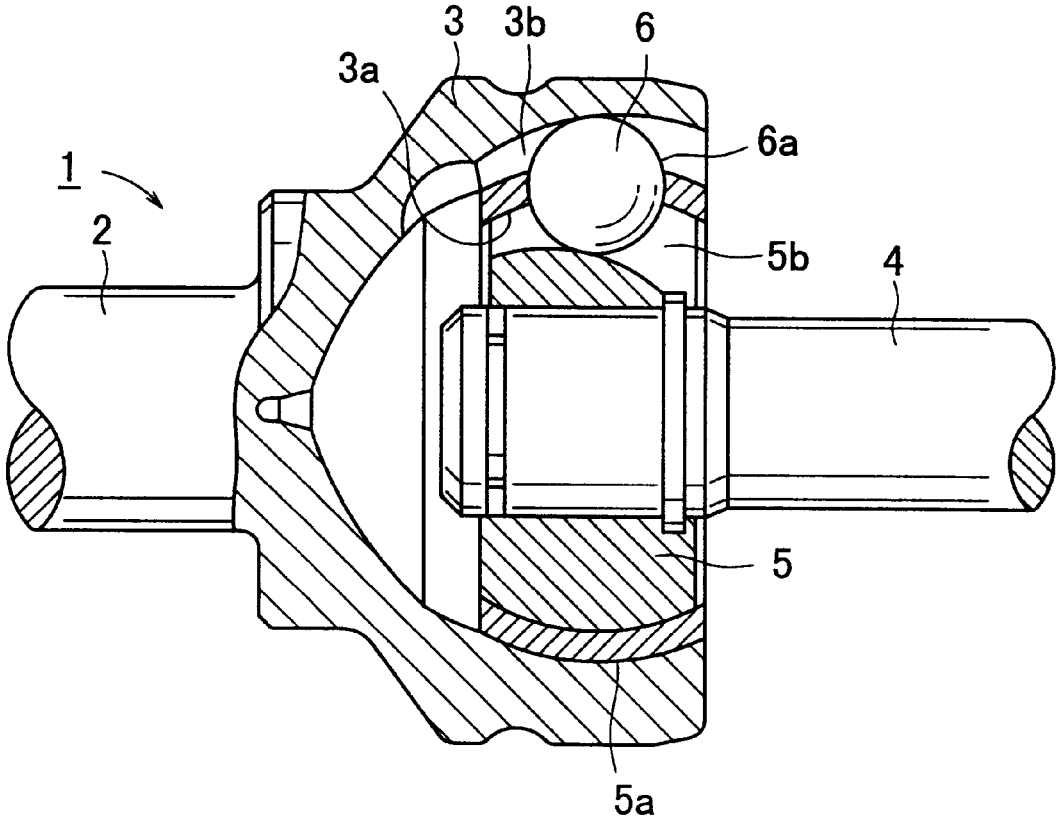
FIG. 1 is a vertical cross-sectional view of a Barfield constant-velocity joint for a drive shaft of an independent-suspension front-wheel-drive automobile.
Figure 2:
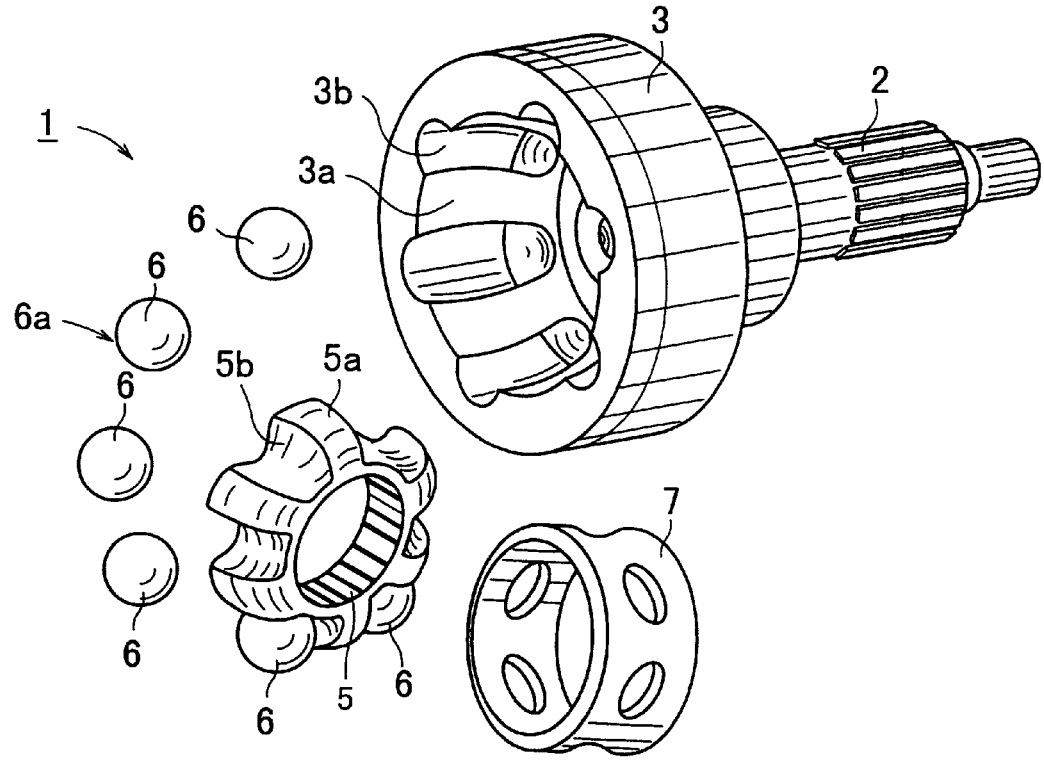
FIG. 2 is an exploded perspective view of the Barfield constant-velocity joint shown in FIG. 1.

FIG. 1 shows in vertical cross section a Barfield constant-velocity joint for a drive shaft of an independent-suspension front-wheel-drive automobile. The Barfield constant-velocity joint incorporates balls according to the present invention. FIG. 2 shows in exploded perspective the Barfield constant-velocity joint shown in FIG. 1.

As shown in FIGS. 1 and 2, the Barfield constant-velocity joint, generally denoted at 1, comprises an outer race 3 having on a closed end thereof a hub shaft 2 having an end connected to a wheel (not shown) for transmitting rotational power thereto, an inner race 5 in which there is fitted a drive shaft 4 having an end connected to a transmission for receiving rotational power therefrom, six balls 6, and a retainer 7. The inner race 5 has an outer spherical surface 5*a* having six ball grooves 5*b* defined therein at equally spaced angular intervals. The outer race 3 has an inner spherical surface 3*a* having six ball grooves 5*b* defined therein in radial alignment with the respective ball grooves 5*b*. The balls 6 are slidably and rollingly fitted in the respective ball grooves 3*b*. The retainer 7 retains the balls 6 in position between the inner race 5 and the outer race 3. Each of the balls 6 has a size of 11/16 inch (a diameter of 17.46 mm). The ball grooves 3*b*, 5*b* transmit a torque to the balls 6 in the direction in which the Barfield constant-velocity joint 1 rotates, and extend such that the balls 6 can slide and roll in the axial direction of the Barfield constant-velocity joint 1. The ball grooves 3*b*, 5*b* allow the drive shaft 4 connected to the inner race 5 and the hub shaft 2 connected to the outer race 3 to intersect with each other, i.e., to extend at an angle to each other.

In the present embodiment, each of the balls 6 of the Barfield constant-velocity joint 1 was manufactured as follows: A ball made of bearing steel and having a size of 11/16 inch was nitrided for 3 hours with a carbon potential of 0.6% with ammonia added in an amount of 1% of the carrier gas at an atmospheric temperature of 840° C. After the ball was quenched in oil, it was tempered at 200° C. for 2 hours. When the ball was nitrided, the carbon potential was 0.6% in order to prevent the bearing steel from being decarburized and also prevent the bearing steel from being carburized. The carbon potential corresponds to the carbon concentration of a matrix of bearing steel. With such a level of carbon potential, the bearing steel is not carburized. The ball thus nitrided had a surface 6*a* whose hardness was HRC 62.

The outer race 3 is made of S53C, and the ball grooves 3*b* are subjected to high frequency induction hardening to provide a surface hardness of HRC 61. The inner race 5 is made of SCM 420, and the ball grooves 5*b* is carburized to provide a surface hardness of HRC 63.

Figure 3:
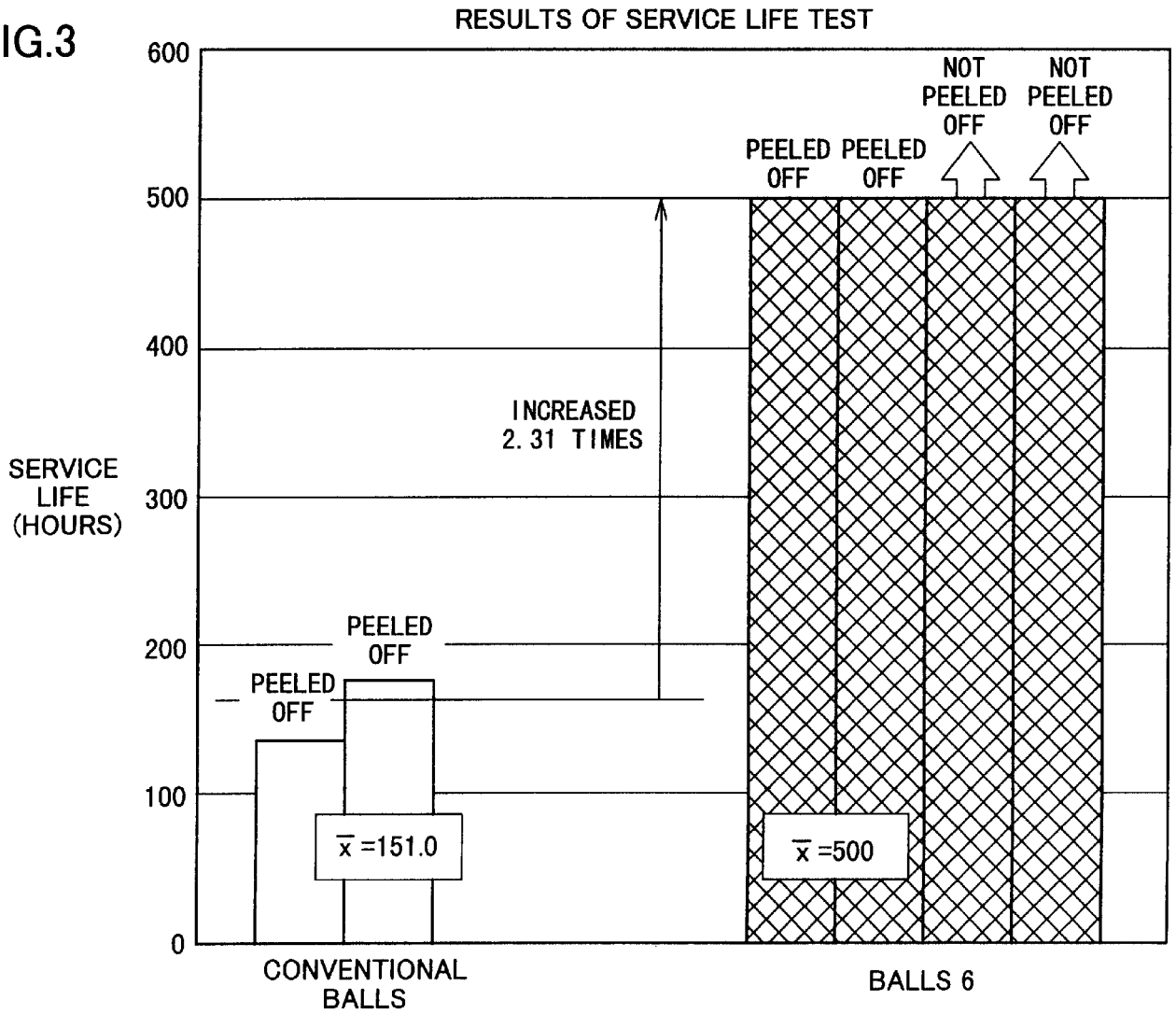
FIG. 3 is a diagram showing, for comparison, the results of a service life test conducted on conventional balls and balls according to the present invention.

A comparison test was conducted on balls 6 according to the present invention and conventional balls by rotating the constant-velocity joint 1 shown in FIGS. 1 and 2 at an axis intersecting angle of 8°. The results of the comparison test are shown in FIG. 3. A review of FIG. 3 indicates that the conventional balls suffered a ball surface peel-off in an average time of 151 hours, whereas two of the four balls 6 suffered a ball surface peel-off in 500 hours and the other two balls 6 had durability over 500 hours. The service life of the balls 6 was 2.61 times the service life of the conventional balls, showing that the nitriding process and the process of increasing the resistance to a crushing load were effective.

Loads for crushing balls 6 which were processed to increase the resistance to a crushing load by tempering them at 200° C. for 2 hours, conventional balls, and carbonitrided 11/16-inch balls which were tempered at 170° C. were measured. The results are shown in Table 1 below. Five balls 6, five conventional balls, and five and carbonitrided 11/16-inch balls were measured. The values set forth in Table 1 are average values.

TABLE 1

Crushing loads for balls

| | Average of crushing loads on n balls (n = 5) |
|---|---|
| Normal balls of bearing steel (Comparative Example) | 330 kN |
| Balls carbonitrided with carbon potential of 1.0% (Comparative Example) | 220 kN (67%) |
| Balls carbonitrided with carbon potential of 1.3% (Comparative Example) | 190 kN (58%) |
| Balls nitrided with carbon potential of 0.6% and processed for increased resistance to crushing load (Balls 6) | 250 kN (76%) |

In Table 1, the numerical values in the parentheses in the right column represent the ratio of the crushing loads to the crushing load of the normal balls of bearing steel. It can be seen from Table 1 that the crushing load of the balls which were carbonitrided are greatly reduced, and the reduction in the crushing load of the balls 6 which were nitrided and then processed for the increased resistance to the crushing load is small.

According to the present invention, as described above, the ball surface is nitrided and further processed to increase the resistance to a crushing load. Therefore, it is possible to produce a ball for a constant-velocity joint which is resistant to surface damage and also against high surface pressure, and is of high strength, and as a result to produce a ball for a constant-velocity joint which is highly durable and is of a long service life. The desired quality of the ball can be achieved by keeping the surface hardness of the ball in the range from HRC 60 to 64. The desired resistance to a crushing load can easily be accomplished by tempering the carbonitrided or nitrided ball in a temperature range from 180 to 230° C. Therefore, no special heat treatment facility is required to manufacture the ball.

Since the ball for use in a constant-velocity joint according to the present invention is resistant to surface damage and a high surface pressure, it can cope with higher torques produced by automobiles without the need for increasing its size. Since balls whose sizes have been reduced according to the present invention can handle torques equal to those which are applied to general-size balls, constant-velocity joints incorporating the balls according to the present invention can be reduced in size.

Although certain preferred embodiments of the present invention has been shown and described in detail, it should be understood that various changes and modifications may be made therein without departing from the scope of the appended claims.

What is claimed is:

1. A ball for use in a constant-velocity joint, which is adapted to be interposed between an inner race and an outer race for transmitting rotational power therebetween, said ball being made of bearing steel or a material equivalent thereto, and having a surface nitrided and processed for increased resistance to a crushing load by tempering in a temperature range from 180 to 230° C.

2. A ball according to claim 1, wherein said ball has a surface hardness ranging from 60 to 64 on a Rockwell hardness C scale.

3. A method of manufacturing a ball for use in a constant-velocity joint, which is adapted to be interposed between an inner race and an outer race for transmitting rotational power therebetween, comprising the steps of:

nitriding a surface of a ball made of bearing steel or a material equivalent thereto; and processing the nitrided ball for increased resistance to a crushing load by tempering the nitrided ball in a temperature range from 180 to 230° C.

* * * * *